US007571715B2

(12) United States Patent
Frasch et al.

(10) Patent No.: US 7,571,715 B2
(45) Date of Patent: Aug. 11, 2009

(54) ELECTRICAL DISCONNECTION IN FUEL INJECTORS

(75) Inventors: Juergen Frasch, Holzgerlingen (DE); Christoph Butscher, Leonberg (DE); Michael Fleig, Gerlingen (DE); Stephan Wehr, Heiligenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 11 days.

(21) Appl. No.: 11/722,541

(22) PCT Filed: Dec. 16, 2005

(86) PCT No.: PCT/EP2005/056850

§ 371 (c)(1),
(2), (4) Date: Jun. 22, 2007

(87) PCT Pub. No.: WO2006/081896

PCT Pub. Date: Aug. 10, 2006

(65) Prior Publication Data

US 2008/0121215 A1 May 29, 2008

(30) Foreign Application Priority Data

Jan. 31, 2005 (DE) ..... 10 2005 004 327

(51) Int. Cl.
*F02M 51/00* (2006.01)
*F02M 51/06* (2006.01)

(52) U.S. Cl. ..... 123/490; 123/499

(58) Field of Classification Search ..... 123/467, 123/490, 498, 499; 251/129.09; 239/585.1, 239/585.2, 585.3, 584.4, 585.5, 600; 29/606, 29/602.1, 603.02, 890.124; 335/268, 259
See application file for complete search history.

(56) References Cited

U.S. PATENT DOCUMENTS

| | | | | |
|---|---|---|---|---|
| 3,412,971 | A * | 11/1968 | McDivitt | 251/129.1 |
| 4,295,453 | A * | 10/1981 | Seilly et al. | 123/499 |
| 4,681,143 | A * | 7/1987 | Sato et al. | 137/625.37 |
| 5,141,164 | A * | 8/1992 | Ohno et al. | 239/585.2 |
| 6,036,120 | A * | 3/2000 | Varble et al. | 239/585.1 |
| 6,113,014 | A * | 9/2000 | Coldren et al. | 239/585.1 |
| 6,206,304 | B1 * | 3/2001 | Koseki et al. | 239/533.12 |
| 2002/0088879 | A1 | 7/2002 | Dallmeyer et al. | |
| 2003/0094516 | A1 * | 5/2003 | Hanneke et al. | 239/585.1 |
| 2003/0150930 | A1 | 8/2003 | Bauer et al. | |
| 2004/0041038 | A1 * | 3/2004 | Delaney et al. | 239/585.1 |
| 2004/0232259 | A1 * | 11/2004 | Kienzler | 239/533.2 |

FOREIGN PATENT DOCUMENTS

| | | |
|---|---|---|
| DE | 101 54 576 C1 | 4/2003 |
| GB | 2 341 893 A | 3/2000 |

* cited by examiner

*Primary Examiner*—Mahmoud Gimie
(74) *Attorney, Agent, or Firm*—Ronald E. Griegg

(57) ABSTRACT

A fuel injector with an injector body is disclosed which has at least two separate function units that are largely independent of one another. The function units are reversibly joined to one another by a connecting element and at least one positioning pin. The two function units can be produced and tested separately, which greatly simplifies both the production process and maintenance of the fuel injectors and lessens the vulnerability of the fuel injectors to malfunction.

15 Claims, 7 Drawing Sheets

ELECTRICAL DISCONNECTION IN FUEL INJECTORS

CROSS-REFERENCE TO RELATED APPLICATION

This application is a 35 USC 371 application of PCT/EP 2005/056850 filed on Dec. 16, 2005.

BACKGROUND OF THE INVENTION

1. Field of the Invention

In fuel injection systems for direct-injection internal combustion engines, fuel injectors that contain one or more electrically triggerable valves are employed. For instance, an electrically triggerable magnet valve or piezoelectric valve may be provided for controlling a needle valve and thus for controlling the course of injection. Further valves may be used, for instance for a pressure boost. Separately testing the functionality of the various valves and the components connected to these valves or controlled by these valves, however, is often a challenge.

2. Prior Art

Since the electrically triggerable valve or valves are typically accommodated in the interior of an injector body, the production, testing and electrical contacting of these electrically triggerable valves as well as maintenance of the electrically triggerable valves often present considerable technical difficulties.

In many cases, on top of the injector body there is an electrical contact that can be connected to a corresponding control system and power supply system located outside the injector body. Via this contact (which may be either a plug with multiple contacts, or a plurality of individual plugs), all the electrically triggerable valves received in the interior of the injector body are as a rule triggered. In the interior of the injector body, this electrical contact must be connected to corresponding contacts of the electrically triggerable valve or valves of the injection system. This connection is typically done by means of flexible electrical cables and a simple soldering process.

This method for electrically contacting the electrically triggerable valves is associated with various disadvantages, however. For instance, the method is technically quite labor-intensive, since typically the cables must be initially soldered by hand against the corresponding electrical contacts. In practice, this method step requires great effort and is very time-consuming. Moreover, the connection between the electrically triggerable valves and the electrical contact on the injector body can be undone again only with difficulty. For removing or disassembling the injector body, soldered or welded connections must typically be disconnected again. Such a labor-intensive process makes it uneconomical to repair the injectors or replace individual parts of the injector body.

Moreover, in this method, testing the various functionalities of the fuel injectors sometimes presents major problems. In many cases, if a malfunction occurs in testing in the installed state, the fuel injector must be disassembled again, which is labor-intensive. Once the repair or replacement of individual components (such as of an electrically triggerable valve) has been done and the parts have been installed again, the functionality must then be tested again. In many cases, this method is too labor-intensive and thus uneconomical.

SUMMARY AND ADVANTAGES OF THE INVENTION

According to the invention, a fuel injector for injecting fuel into a combustion chamber of an internal combustion engine and a method for producing such a fuel injector are therefore proposed which avoid the described disadvantages of the prior art. A fundamental concept of the present invention is that an injector body of the fuel injector has at least two separate function units, which (for instance at least with regard to at least one functionality) are functional independently of one another and can be tested independently of one another. For instance, one function unit may have a control module for controlling a pressure boost of a fuel pressure, and another function unit may have a nozzle module for triggering an injection event by an injection valve member. The function units are reversibly connected or joined to one another via at least one nonpositive-engagement connecting element (such as a union nut) and at least one positioning pin. Instead of one or more positioning pins, according to the invention means that function the same way may also be employed, such as protrusions in the housing of one function unit that engage corresponding grooves in the other function unit and thus prevent relative rotation of the function units and make positioning the function units relative to one another easier.

The two function units each have at least one electrically triggerable valve (such as a magnet valve). Moreover, the fuel injector may have at least one electrical injector body contact, which is accessible from outside the injector body, and the second electrically triggerable valve has at least one valve contact, and the at least one electrical valve contact and the at least one electrical injector body contact are joined at least in part via at least one electrical solid conductor that is substantially dimensionally stable under its own weight. This electrical connection between valve contacts and the injector body contact can advantageously also include at least one electric plug contact, into which the at least one electrical solid conductor for instance is plugged.

In comparison to the prior art, the fuel injector of the invention makes a highly simplified production process possible. For instance, in particular, a first function unit can first be produced and tested, for instance with regard to the functionality of an electrically triggerable valve. Next, or parallel to this, a second function unit is produced and tested, for instance again with regard to the functionality of an electrically triggerable valve. Finally, the function units are reversibly joined to one another by means of the nonpositive-engagement connecting element, and an electrical connection between the at least one injector body contact and the at least one valve contact is made, for instance by means of plugging into an electric plug contact.

The separate testing of the individual function units enhances the process stability in the production of the fuel injectors considerably, and makes it possible to detect defects (such as electrical defects of the individual valves) early and eliminate them if applicable. The function units may thus also be produced separately and independently of one another. Simple removal and repair for maintenance purposes is possible. This lowers the overall costs of production and repair and enhances the reliability of the fuel injectors.

BRIEF DESCRIPTION OF THE DRAWINGS

The invention is described in further detail below in terms of the exemplary embodiments shown in the drawings. Identical reference numerals designate components that are the same as one another or correspond to one another in their function. Individually, the drawings show.

DESCRIPTION OF THE PREFERRED EMBODIMENTS

Figure 1:
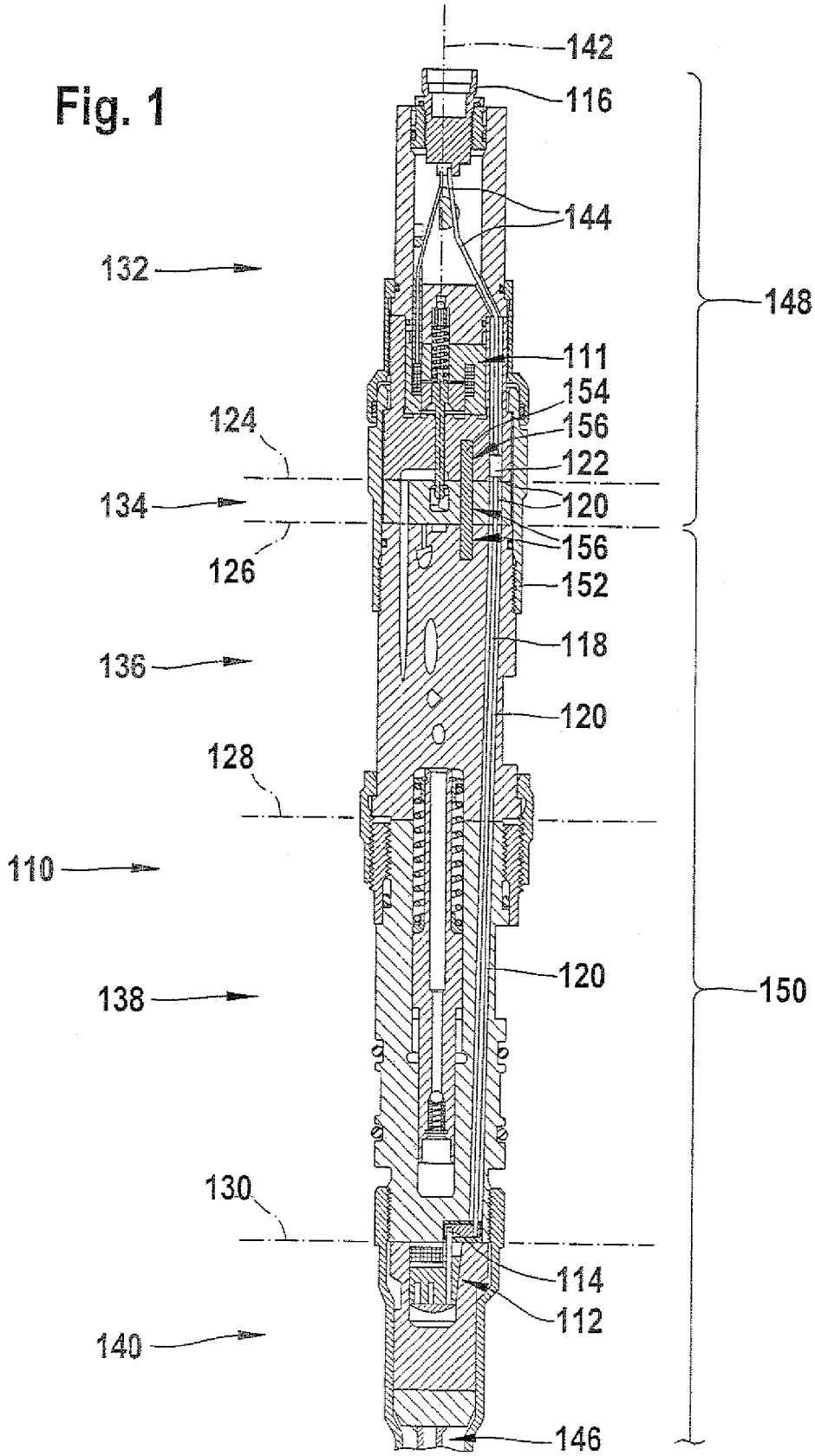
FIG. 1, a sectional view of a fuel injector that has a first function unit (control unit) and a second function unit (nozzle unit)

In FIG. 1, an overall view of a preferred exemplary embodiment of an injector body 110 for a common rail injection system is shown. The injector body 110 can be disassembled at the butt joints 124, 126, 128 and 130 into essentially five function modules, namely one control module 132, one sealing plate 134, one line connection module 136, one pressure booster module 138, and one nozzle module 140. The pressure booster module 138 serves essentially to boost a fuel pressure (for instance, 1000 bar), which is made available at the fuel injector from an external pressure source, for instance via a high-pressure collection chamber (common rail) to a second pressure (for instance 2200 bar), so that two operating pressures are available for the injection event. The nozzle module 140 has an injection valve member 146 (shown only symbolically in FIG. 1), such as a nozzle needle, which controls the actual injection event into the combustion chamber of an internal combustion engine (for instance via injection openings).

The modules 132, 134, 136, 138 and 140 are grouped in this exemplary embodiment into two function units, namely one control unit 148 including the control module 132 and the sealing plate 134, and one nozzle unit 150 including the line connection module 136, the pressure booster module 138, and the nozzle module 140. These two function units 148 and 150 are separated or disconnected from one another by the second butt joint 126 and are reversibly joined together by a union nut 152. The function units 148, 150 are furthermore joined together via the positioning pins 154 (in the sectional view of FIG. 1, only one of the positioning pins 154 can be seen), which are each received in corresponding positioning bores 156 in the control module 132, in the sealing plate 134, and in the line connection module 136.

The injector body 110 furthermore has two magnet valves 111, 112: a first magnet valve 111, disposed in the control module 132, for controlling the pressure boost in the pressure booster module 138, and a second magnet valve 112, disposed in the nozzle module 140, for controlling the actual injection event via the injection valve member 146.

Because two function units 148, 150 are separable or disconnectable along the second butt joint 126, the ("dry") control module 132 and the ("wet") part of the injector body 110 located below the first butt joint 124 can be designed, produced and tested separately, and then put together. Moreover, because of this separability, individual components of the injector body 110 can easily be replaced for maintenance purposes, for instance, which is in accordance with the "system repair concept" (SRC).

The magnet valve 112 in the nozzle module 140 is electrically triggerable via two electrical valve contacts 114. The injector body 110, on its upper end, has an electrical injector body contact 116 that is accessible from above. In the modular construction of the injector body 110 as shown, the capability of breaking down the injector body 110 and of simple modular assembly is achieved by providing that the valve contacts 114 be connected electrically to the injector body contact 116 in such a way that simple assembly and capability of breaking down the injector body continue to be assured.

In this exemplary embodiment, for connecting the two electrical valve contacts 114 to the injector body contact 116, two conductor conduits 120 are provided, which extend through the modules 138, 136 and 134. The conductor conduits 120 are formed by bores in the pressure booster module 138, in the line connection module 136, and in the sealing plate 134. Once the injector body 110 has been put together, these bores are each aligned at the butt joints 128 and 126, so that the result is a single, continuous conductor conduit 120.

The individual bores of the conductor conduit 120, in this exemplary embodiment, in the various modules 138, 136, 134 each have a rectilinear course. With the provisions of the invention, a curved course of the bores can also be achieved. However, the bores in the individual modules 138, 136, 134 do have a different inclination relative to an injector axis 142. While the conductor conduit 120 in the pressure booster module 138 has an inclination of 1° to the injector axis 142, the inclination in the line connection module 136, in this exemplary embodiment, is 2.2°. These different angles of inclination relative to the injector axis 142 are due to the fact that the injector body 110 tapers in its cross section toward the bottom, that is, from the control module 132 to the nozzle module 140.

The connection between the two electrical valve contacts 114 of the magnet valve 112 and the injector body contact 116 is effected, in this exemplary embodiment, in part via two solid conductors 118. The solid conductors 118 extend through the two conductor conduits 120 and connect the valve contacts 114 to electric plug contacts 122, which in turn are connected to the injector body contact 116 via an electrical connection 144 (for instance, two cables each soldered at one end to an electric plug contact 122 and at another end to the injector body contact 116). The solid conductors 118 are thus fixedly or detachably connected electrically to the valve contacts 114 of the magnet valve 112.

The connection of the solid conductors 118 to the plug contacts 122 is done reversibly, so that this connection can be made upon assembly of the injector body 110, or in other words when the control unit 148 and nozzle unit 150 are put together, by simply pressing the solid conductors 118 into the plug contacts 122. Conversely, in the event of maintenance, the solid conductors 118 can be easily removed from the plug contacts 122 again, and thus the injector body 110 can be broken down into the two function units 148, 150 again without having to unsolder electrical connections.

The solid conductors 118 are selected to be rigid enough that on the one hand they do not substantially change their shape under their own weight, and can thus be easily threaded through the conductor conduits 120 with their different inclinations to the injector axis 142 and plugged into the plug contacts 122. The solid conductors should have a certain plasticity, so that no mechanical stresses arise either at the transition between portions of the conductor conduits 120 that have different angles of inclination. The term "solid conductor" does not necessarily narrow the choice of materials to solid elements; on the contrary, hollow conductors (tubes) may for instance also be used as solid conductors 118, as long as they have sufficient mechanical rigidity.

In the exemplary embodiment shown in FIG. 1, the solid conductors 118 have as their material CuSn6 with a Brinell hardness of between 80 and 90 HB, a material that is otherwise used as a welding additive, for instance. Alternatively, however, CuAl8, CuAl8Ni2, CuAl8Ni6, CuAl9Fe, CuMn13Al7, CuSi3, CuSn, copper, or nickel silver, for instance, can also be used. These materials meet the aforementioned requirements in terms of hardness and plasticity and moreover are easily joined to the valve contacts 114 by welding. The hardness of the materials should be between 50 and 100 HB, preferably between 60 and 95 HB, and especially advantageously between 75 and 90 HB.

Figure 2A:
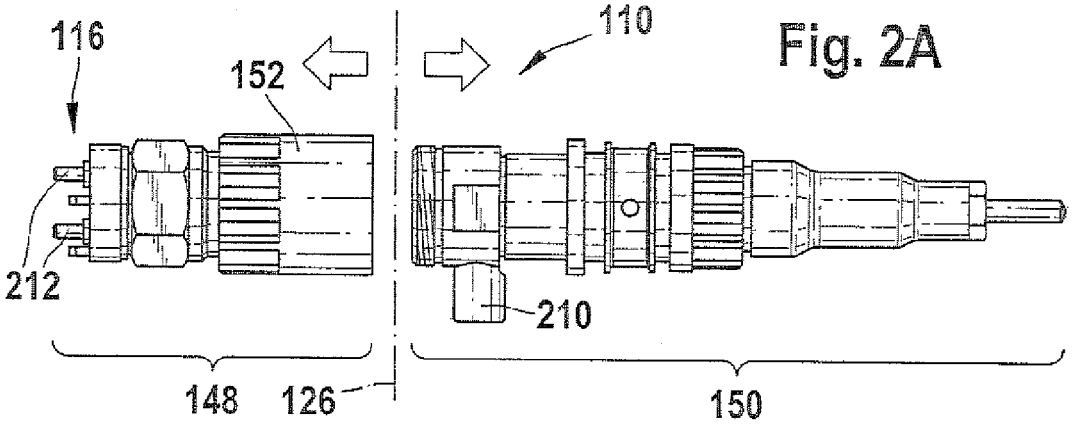
FIG. 2A, a perspective view of the disconnection of the control unit and nozzle unit.
Figure 2B:
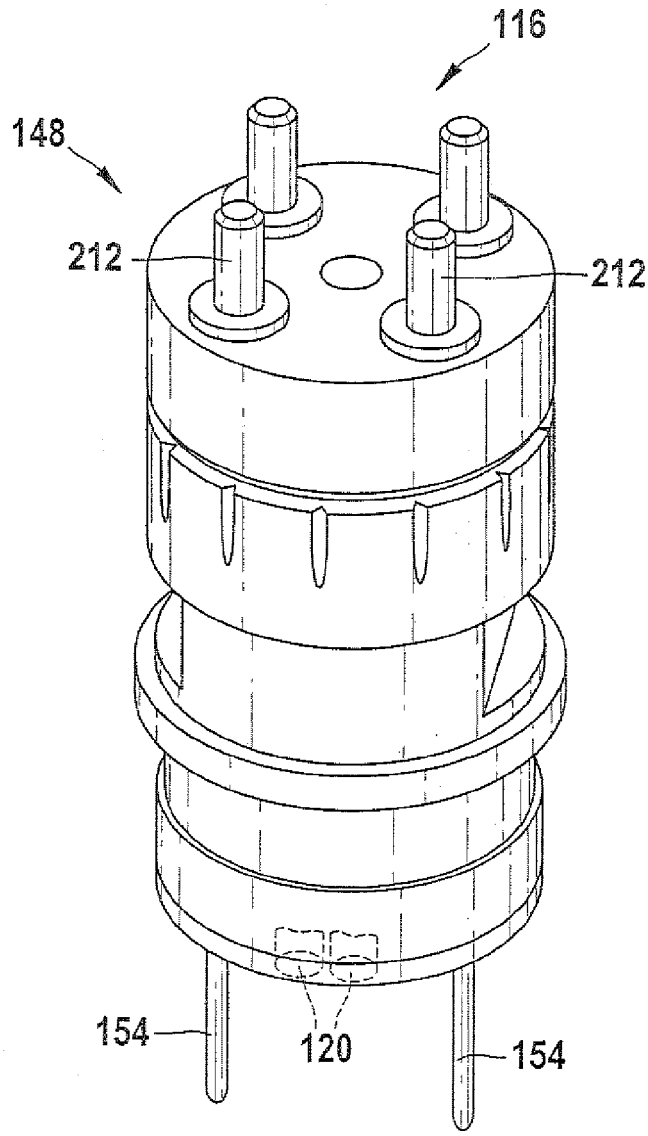
FIG. 2B, a perspective view of the control unit.
Figure 2C:
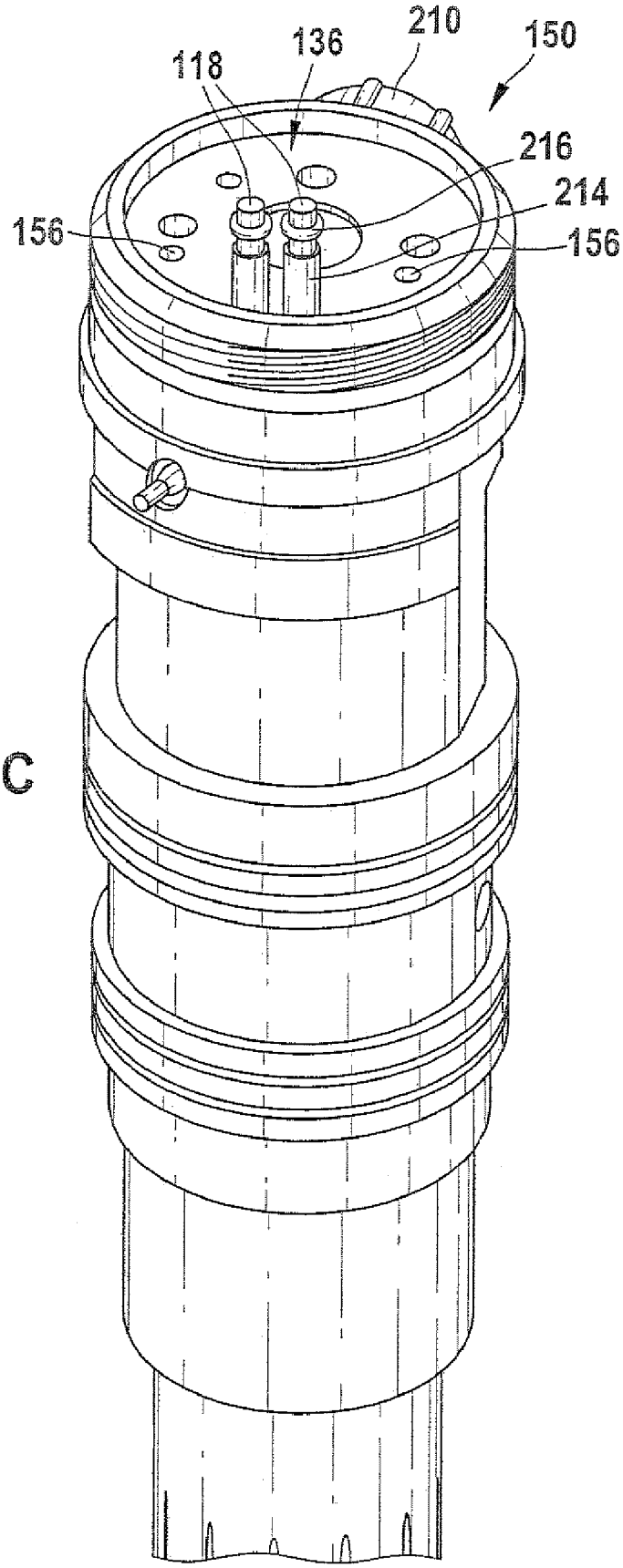
FIG. 2C, a perspective fragmentary view of the nozzle unit.

In FIGS. 2A through 2C, the assembling of the fuel injector from the two individual function units 148 and 150 is shown in perspective. Particularly in FIG. 2A, it can be seen how the control unit 148 and the nozzle unit 150 can be disconnected from one another along the butt joint 126 by loosening the union nut 152. It can also be seen in FIG. 2A that the nozzle unit 150 has a fuel delivery stub 210, by way of which the nozzle unit 150 can be supplied with fuel. This fuel delivery stub 210 may for instance be in communication with a high-pressure collection chamber (common rail). In particular, in this exemplary embodiment, the sealing plate 134 (see FIG. 1), which is disposed in the control unit 148, may be designed such that it prevents fuel from the nozzle unit 150 from getting into the control unit 148 via the butt joint 126. Thus the butt joint 126, as already described above, separates the "wet" nozzle unit 150 from the "dry" control unit 148. This furthermore contributes to the fact that the two function units 148, 150 can be produced separately and tested separately.

In FIG. 2B, a control unit is shown in perspective. It can be seen here that the injector body contact 116, which is disposed on the top of the control unit 148, has four individual connection pins or bolts 212 in this exemplary embodiment. Via two at a time of these connection bolts 212, a given one of the two magnet valves 111, 112 can each be triggered.

It can also be seen in FIG. 2B that in this exemplary embodiment, two positioning pins 154 are let into the control unit 148. These positioning pins 154 can for instance be let into corresponding positioning bores 156 of the control unit 148 (see FIG. 1) either fixedly or detachably. As already described above, according to the invention, instead of positioning pins 154, still other devices may be employed which make it easier to position the function units 148, 150 relative to one another and prevent the function units 148, 150 from rotating relative to one another. In particular, protrusions and corresponding grooves may be named in this respect.

In FIG. 2C, in a fragmentary perspective view, the upper end of the nozzle unit 150 is shown. It can be seen here that the upper ends of the solid conductors 118 protrude from the line connection module 136. For insulation from the injector body 110, the solid conductors 118 are sheathed with shrink-fit hoses 214, but the upper ends are stripped of insulation for the sake of contacting. As can be seen in conjunction with FIG. 1, when the function units 148, 150 are put together, the upper ends of the solid conductors 118 are thrust through conductor conduits 120 in the sealing plate 134 and are plugged into the plug contacts 122. In addition, in this exemplary embodiment, O-rings 216 are slipped onto the ends of the solid conductors 118 at the top and are additionally meant to prevent fuel from the nozzle unit 150 from getting into the control unit 148 along the solid conductors 118.

In FIG. 2C, the orifices of the positioning bores 156 can also be seen, into which the positioning pins 154 of the control unit 148 are thrust when the two function units 148, 150 are joined together, in order to assure exact positioning of the control unit 148 relative to the nozzle unit 150 and thus to make it possible to plug the solid conductors 118 "blind" into the plug contacts 122.

Figure 3A:
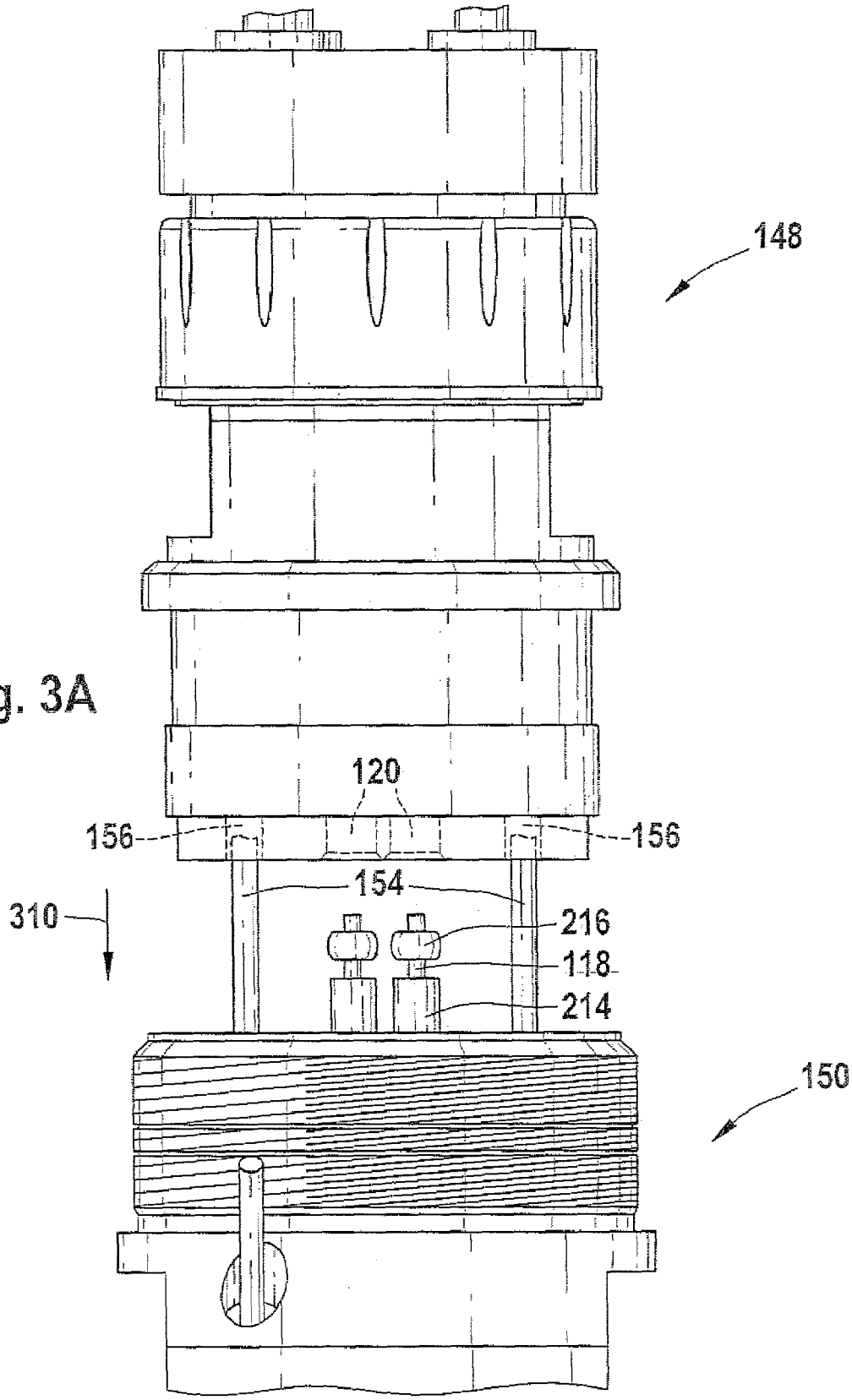
FIG. 3A, a perspective view of a control unit positioned relative to a nozzle unit by means of positioning pins.
Figure 3B:
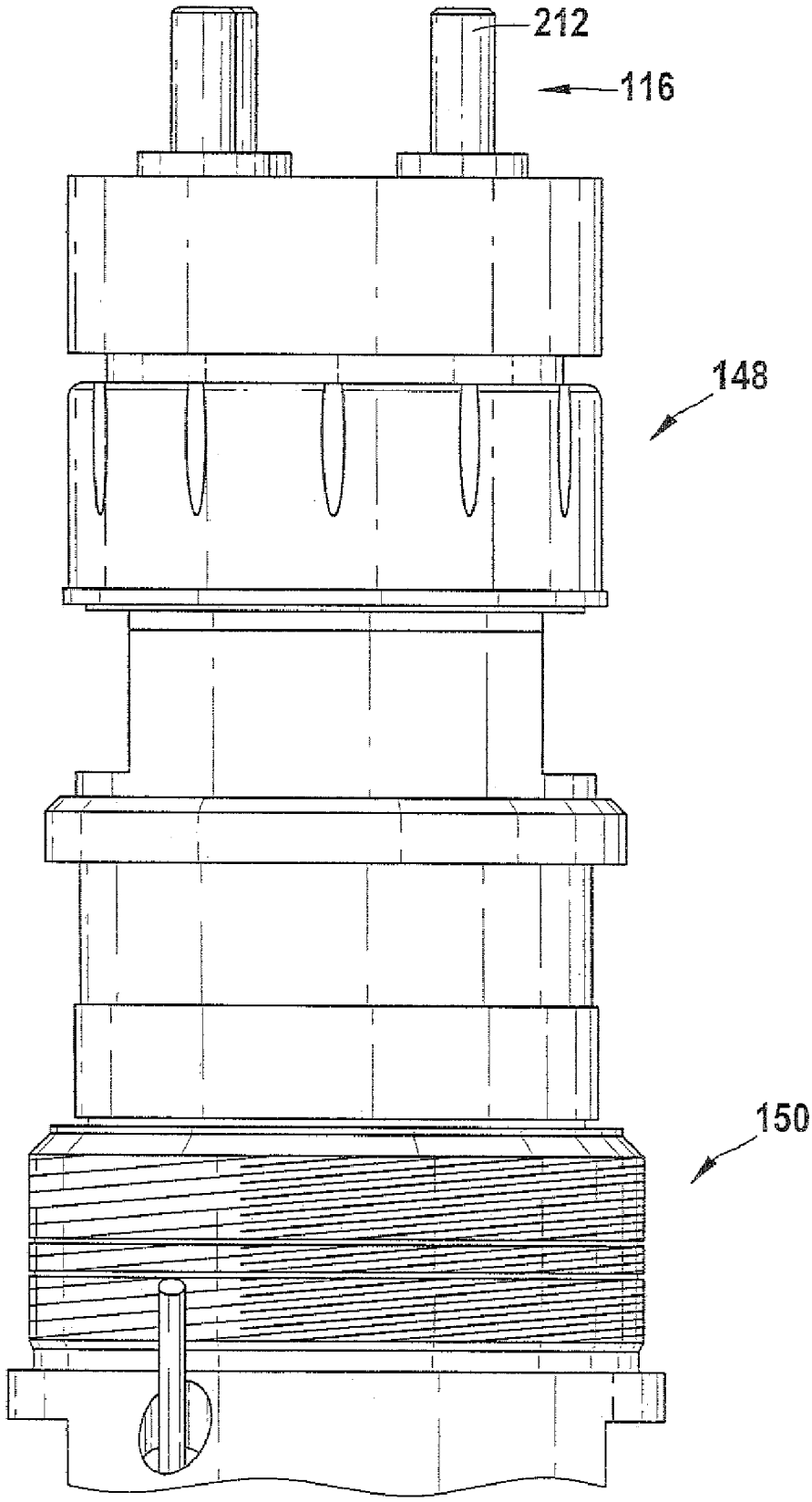
FIG. 3B, a perspective view of the function units of FIG. 3A, after the control unit and nozzle unit have been put together.
Figure 3C:
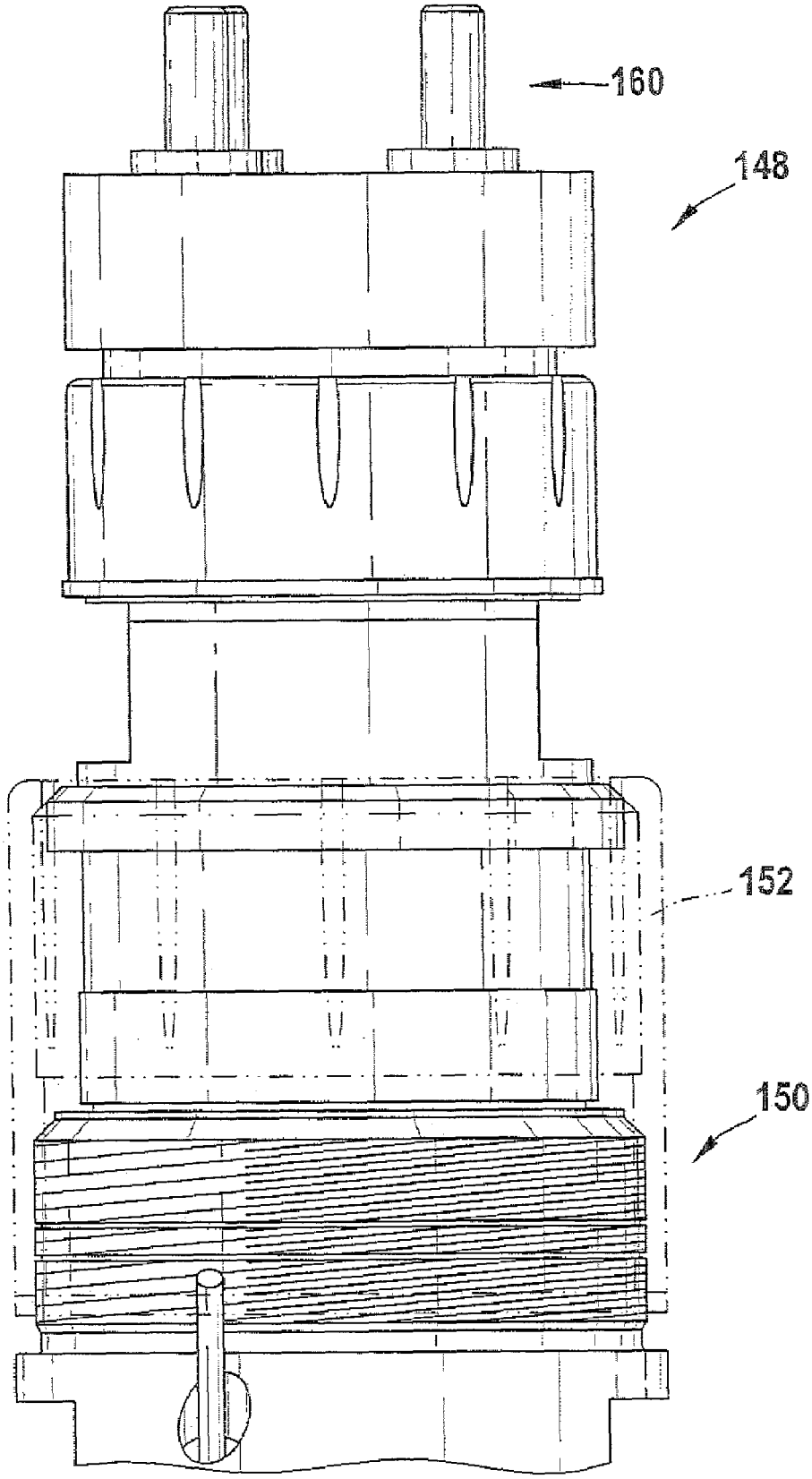
FIG. 3C, a perspective view of a nonpositive-engagement connection of the two function units of FIG. 3B by means of a union nut.

In FIGS. 3A through 3C, the joining together of function units 148, 150 is shown in perspective. First, as shown in FIG. 3A, the positioning pins 154, which as can be seen in FIG. 2B are fixedly connected to the control unit 148 in this exemplary embodiment, are thrust into the positioning bores 156 in the nozzle unit 150. As a result, the control unit 148 is positioned relative to the nozzle unit 150, and thus the two function units 148, 150 can no longer rotate relative to one another. The plug contacts 122 thus already have the correct position relative to the upper ends of the solid conductors 118 as well. "Blindly" joining the two function units 148, 150 together by a motion of the control unit 148 in the joining direction 310 is thus possible, in which the upper ends of the solid conductors 118 are plugged into the plug contacts 122 and an electrical connection between the valve contacts 114 of the second magnet valve 112 and the injector body contact 116 is thus made (see FIG. 1). The status of the two function units 148, 150 after the two function units 148, 150 have been put together is shown in perspective in FIG. 2B. The union nut 152 has been left out of FIGS. 3A and 3B for the sake of simplicity. Once the two function units 148, 150 have been put together, the two function units are connected by nonpositive engagement to one another by screwing down the union nut 152. For maintenance purposes, this connection by the union nut 152 can easily be undone again, so that the two function units 148, 150 can for instance be tested and repaired separately from one another.

Figure 4:
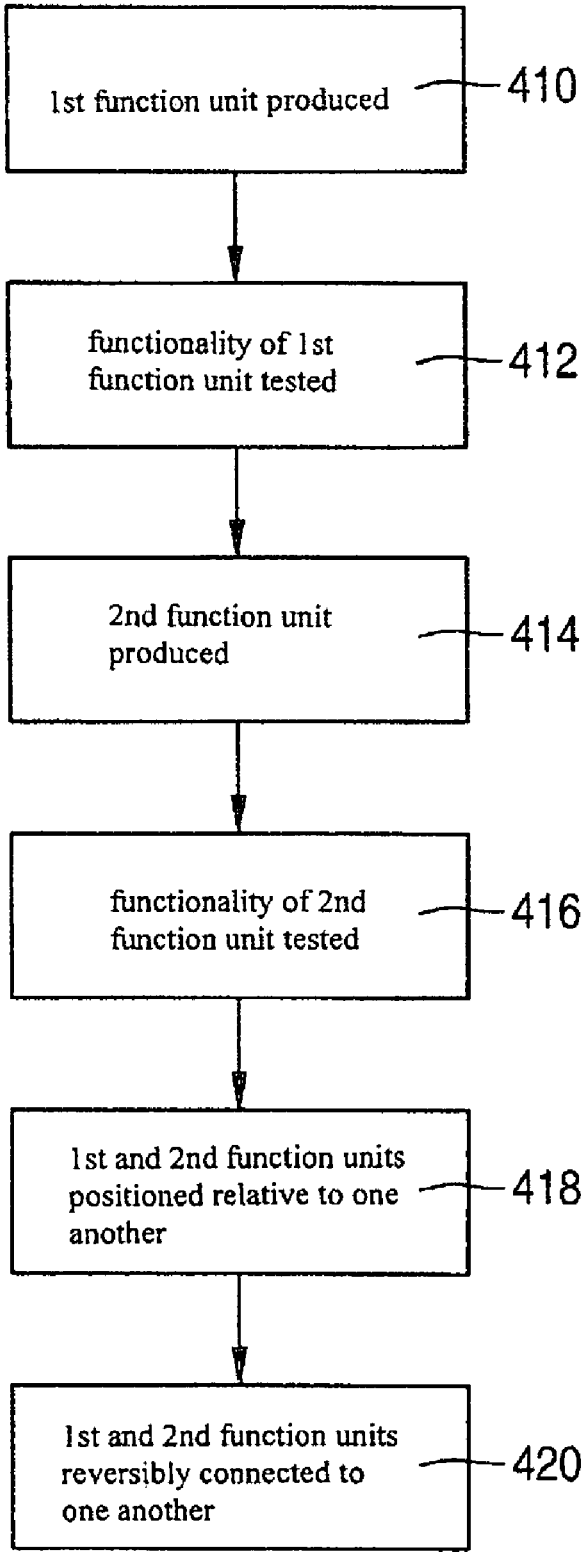
FIG. 4, a flow chart of a method according to the invention.

In FIG. 4, a schematic flow chart of a method according to the invention for producing a fuel injector is shown. The method steps shown need not necessarily be performed in the order shown, and still other method steps not shown in FIG. 4 may also be performed.

In a first method step 410, a first function unit 148 of a fuel injector is produced; it has at least one injector body contact 116 and at least one first electrically triggerable valve 111. In method step 412, a first functionality of the first function unit 148, in particular an electrical function of the first electrically triggerable valve 111, is tested.

Independently of method steps 410 and 412, in method step 414 a second function unit 150 is produced, which has at least one second electrically triggerable valve 112 with at least one electrical valve contact 114. In method step 416, a second functionality of this second function unit 150, in particular an electrical function of the second electrically triggerable valve 112, is tested. In the (optional) method step 418, the two function units 148, 150 are then positioned relative to one another by means of at least one positioning pin 154. Next, in method step 420, the first function unit 148 and the second function unit 150 are reversibly connected to one another at a butt joint 126 by means of at least one nonpositive-engagement connecting element 152, whereupon an electrical connection is made between the at least one injector body contact 116 and the at least one valve contact 114.

The foregoing relates to a preferred exemplary embodiment of the invention, it being understood that other variants and embodiments thereof are possible within the spirit and scope of the invention, the latter being defined by the appended claims.

The invention claimed is:

1. A fuel injector for injecting fuel into a combustion chamber of an internal combustion engine, the fuel injector having an injector body comprising a first function unit that has at least one first electrically triggerable valve, at least one second function unit differing from the first function unit and having at least one second electrically triggerable valve, and at least one nonpositive-engagement connecting element and at least one positioning pin reversibly joining the first function unit and the second function unit at a butt joint, wherein the first function unit comprises at least one electrical injector body contact which is accessible from outside the injector body, wherein the second electrically triggerable valve comprises at least one valve contact, and wherein the at least one electrical valve contact and the at least one electrical injector body contact are joined at least in part via at least one electrical solid conductor that is substantially dimensionally stable under its own weight.

2. The fuel injector as defined by the foregoing claim 1, wherein the nonpositive-engagement connecting element comprises at least one union nut.

3. The fuel injector as defined by claim 1, further comprising at least one electric plug contact for plugging in the at least one electrical solid conductor for producing an electrical connection between the injector body contact and the at least one valve contact.

4. The fuel injector as defined by claim 2, further comprising at least one electric plug contact for plugging in the at least one electrical solid conductor for producing an electrical connection between the injector body contact and the at least one valve contact.

5. The fuel injector as defined by claim 1, wherein the first electrically triggerable valve and/or the second electrically triggerable valve comprises at least one magnet valve.

6. The fuel injector as defined by claim 2, wherein the first electrically triggerable valve and/or the second electrically triggerable valve comprises at least one magnet valve.

7. The fuel injector as defined by claim 3, wherein the first electrically triggerable valve and/or the second electrically triggerable valve comprises at least one magnet valve.

8. The fuel injector as defined by claim 1, wherein the first function unit and/or the second function unit comprises at least one control module for triggering a pressure boost and/or a nozzle module for triggering an injection valve member.

9. The fuel injector as defined by claim 2, wherein the first function unit and/or the second function unit comprises at least one control module for triggering a pressure boost and/or a nozzle module for triggering an injection valve member.

10. The fuel injector as defined by claim 3, wherein the first function unit and/or the second function unit comprises at least one control module for triggering a pressure boost and/or a nozzle module for triggering an injection valve member.

11. The fuel injector as defined by claim 5, wherein the first function unit and/or the second function unit comprises at least one control module for triggering a pressure boost and/or a nozzle module for triggering an injection valve member.

12. A method for producing a fuel injector, the method comprising producing a first function unit of the fuel injector and the first function unit having at least one injector body contact and at least one first electrically triggerable valve, testing a first functionality of the first function unit, in particular an electrical function of the first electrically triggerable valve, producing a second function unit, the second function unit having at least one second electrically triggerable valve and at least one electrical valve contact, and testing a first functionality of the second function unit, in particular an electrical function of the second electrically triggerable valve, and reversibly joining the first function unit and the second function unit to one another at a butt joint by means of at least one nonpositive-engagement connecting element and making an electrical connection between the at least one injector body contact and the at least one valve contact.

13. The method as defined by claim 12, further comprising positioning the first function unit and the second function unit relative to one another by means of at least one positioning pin.

14. The method as defined by claim 12, further comprising plugging at least one electrical solid conductor that is substantially dimensionally stable under its own weight into at least one electric plug contact.

15. The method as defined by claim 13, further comprising plugging at least one electrical solid conductor that is substantially dimensionally stable under its own weight into at least one electric plug contact.

* * * * *